US009731210B2

(12) United States Patent
Lennon

(10) Patent No.: US 9,731,210 B2
(45) Date of Patent: Aug. 15, 2017

(54) TOY VEHICLE LAUNCHER

(75) Inventor: Berrigan Lennon, Los Angeles, CA (US)

(73) Assignee: Mattel, Inc., El Segundo, CA (US)

( * ) Notice: Subject to any disclaimer, the term of this patent is extended or adjusted under 35 U.S.C. 154(b) by 1175 days.

(21) Appl. No.: 13/452,148

(22) Filed: Apr. 20, 2012

(65) Prior Publication Data

US 2013/0280987 A1 Oct. 24, 2013

(51) Int. Cl.
*A63H 17/00* (2006.01)

(52) U.S. Cl.
CPC ..... *A63H 17/008* (2013.01)

(58) Field of Classification Search
CPC .... A63H 17/008; A63H 18/02; A63H 18/028; A63B 11/642; A63B 69/40; A63B 69/408
USPC ..... 446/429, 430, 444; 124/16, 36, 37
See application file for complete search history.

(56) References Cited

U.S. PATENT DOCUMENTS 2,773,329 A 12/1956 Sherri
3,408,768 A 11/1968 Glass et al.
3,693,282 A 9/1972 Adicks et al.
3,770,272 A * 11/1973 Olivier ..... 273/246
3,908,303 A 9/1975 McKay et al.
4,038,776 A 8/1977 Filipeli
4,060,930 A 12/1977 Hirtle et al.
4,155,194 A 5/1979 Amamoto et al.
4,203,247 A * 5/1980 Moe et al. ..... 446/429
4,227,508 A * 10/1980 D'Andrade ..... 124/16
4,267,661 A 5/1981 Hanson
4,282,848 A * 8/1981 Kulesza et al. ..... 124/16
4,472,906 A 9/1984 Cook et al.
4,475,303 A 10/1984 Ribas et al.
4,504,242 A * 3/1985 Crain ..... A63H 17/008 446/429
4,552,120 A * 11/1985 Nall et al. ..... 124/1
4,642,066 A 2/1987 Kennedy et al.
4,669,444 A * 6/1987 Whitfield et al. ..... 124/16
4,690,654 A * 9/1987 DeLaney ..... 446/28
4,979,753 A * 12/1990 Kobayashi ..... 273/399
5,199,410 A * 4/1993 Cheng ..... 124/10
5,254,030 A 10/1993 Ostendorff et al.
5,299,969 A * 4/1994 Zaruba ..... A63H 18/028 238/10 C
5,316,514 A 5/1994 Ellman et al.
5,390,653 A * 2/1995 Lee et al. ..... 124/16
5,619,977 A * 4/1997 Gatin ..... 124/7
5,676,120 A * 10/1997 Joseph ..... 124/6
6,000,992 A 12/1999 Lambert
6,071,173 A * 6/2000 Kelley ..... 446/465
6,089,215 A * 7/2000 Morris et al. ..... 124/16
6,179,686 B1 * 1/2001 Ogawa ..... A63H 18/00 446/429

(Continued)

*Primary Examiner* — Aarti B Berdichevsky
*Assistant Examiner* — Urszula M Cegielnik
(74) *Attorney, Agent, or Firm* — Edell, Shapiro & Finnan, LLC

(57) ABSTRACT

A toy vehicle launcher is disclosed. The launcher includes a cavity configured for receiving a plurality of toy vehicles. Furthermore, the launcher includes a launching mechanism that launches a single toy vehicle while loading the next vehicle into the launching position in a single action. Additionally, the launching mechanism includes an actuator for triggering the launching of the toy vehicles. Moreover, the launcher is configured for easy access to the storage of the plurality of toy vehicles in the cavity.

18 Claims, 15 Drawing Sheets

(56) References Cited

U.S. PATENT DOCUMENTS

| | | | | |
|---|---|---|---|---|
| 6,371,871 | B1 * | 4/2002 | Rappaport et al. | 473/457 |
| 7,156,085 | B2 | 1/2007 | Lewis et al. | |
| 7,226,372 | B2 * | 6/2007 | Flanigan | 473/417 |
| 7,677,235 | B2 | 3/2010 | Zimmerman | |
| 7,766,720 | B2 | 8/2010 | Ostendorff | |
| 7,892,068 | B2 * | 2/2011 | Nuttall et al. | 446/444 |
| 7,901,266 | B2 | 3/2011 | Ostendorff | |
| 8,668,081 | B2 * | 3/2014 | Hippely | A63H 18/00 206/216 |
| 2003/0131835 | A1 * | 7/2003 | Rice | F41B 11/52 124/49 |
| 2007/0293122 | A1 * | 12/2007 | O'Connor et al. | 446/429 |
| 2009/0130946 | A1 | 5/2009 | Fink et al. | |
| 2010/0093256 | A1 | 4/2010 | Carlson et al. | |
| 2010/0330873 | A1 | 12/2010 | McCafferty et al. | |

* cited by examiner

TOY VEHICLE LAUNCHER

FIELD OF THE INVENTION

The present invention relates to a toy vehicle launcher that retains toy vehicles and launches the toy vehicles in rapid succession.

BACKGROUND OF THE INVENTION

Typically when children play and interact with toy vehicles, the children are required to push the vehicles with their own hands and arms. Oftentimes, children will "launch" these vehicles by pushing the vehicles and letting go, causing the vehicle to move across a support surface.

Another way children play and interact with toy vehicles is with a vehicle launcher that requires the child to load the toy vehicle and then launch the toy vehicle, and then load the toy vehicle again in order to launch another toy vehicle. Therefore, a child must load a vehicle each time the child wants to launch a vehicle.

Therefore, there is a need for a toy vehicle launcher that can hold a plurality of vehicles within the launcher and can launch the plurality of vehicles without requiring a user to load a vehicle each time a user desires to launch a vehicle.

SUMMARY OF THE INVENTION

The present invention is directed to a ball bearing vehicle launcher that may include a housing that retains a plurality of vehicles. In one embodiment, the housing may be built into the launcher and may have a cover that opens for placement of vehicles within the housing. In another embodiment, the entire housing may be movably attached to the launcher, where the housing moves out from the launcher to load the housing with a plurality of vehicles. Furthermore, in one embodiment, the housing may include an actuator that moves vertically for launching the vehicles from within the housing. In another embodiment, the entire housing may act as the actuator and move vertically, launching the plurality of vehicles when the entire housing is moved downwardly.

In one embodiment, a launcher for a toy vehicle includes a housing having a top, a bottom, a front, a rear, a first sidewall, and a second sidewall, with the bottom being configured to support the launcher on a surface. In this embodiment, the launcher further includes a cavity disposed or located within the housing, and the cavity is configured to receive a plurality of toy vehicles. Additionally, the launcher has a launching mechanism disposed within the housing that launches a toy vehicle from a launching position from within the cavity. The launching mechanism has a vehicle retaining device and a striking member. Furthermore, the launcher of the embodiment has an actuator disposed on the housing and coupled to the launching mechanism. The actuator is actuated when it is moved from a first position to a second position where the actuator is closer to the bottom of the housing in the second position. Moreover, the actuation of the actuator triggers the striking member and the vehicle retaining device of the launching mechanism.

In one embodiment, the launcher has a cover pivotally coupled to the housing to facilitate outward movement of the cover from the housing during the loading of toy vehicles within the cavity. Furthermore, the actuator is a button disposed on the top of the housing.

In one embodiment, the striking member is configured to strike the toy vehicle launching the toy vehicle from the launch position out of the launcher. Furthermore, the vehicle retaining device includes claw members configured to retain a vehicle when the striking member strikes the toy vehicle in the launch position and then displaces another toy vehicle into the launching position.

In another embodiment, a launcher for a toy vehicle includes a housing having a top, a base, a front, a rear, a first side, a second side, and a cavity disposed in the front of the housing. The cavity is configured to receive a plurality of toy vehicles. Additionally, an actuator is disposed on the top of the housing, and a launching mechanism is disposed within the housing. The launching mechanism is configured to launch a toy vehicle from a launching position from within the cavity in response to the triggering of the actuator. Moreover, the launching mechanism is configured to displace another toy vehicle into the launching position.

In one embodiment, the toy vehicles are disposed in a vertically stacked alignment within the cavity. The launcher further includes a cover that is pivotally coupled to the housing to facilitate outward movement of the cover from the housing during the loading of toy vehicles within the cavity. The actuator of the launcher is a plunger that moves from a first position to a second position toward the base of the housing. In addition, with regards to the actuator, a portion of the actuator is received within the housing when the actuator is moved to its second position.

In one embodiment, the launching mechanism includes one or more claw members that are configured to displace another toy vehicle into the launching position. Furthermore, the launching mechanism includes a striking member that is configured to strike the toy vehicle to launch the toy vehicle from the launcher.

In one embodiment, the launcher includes a grip that is disposed on the housing. The launcher also includes a clip, which is configured to receive a belt that is disposed on the housing. In this embodiment, the housing of the launcher includes a pivotable track portion. Furthermore, the launching mechanism includes a ramp that is configured to displace the launched toy vehicle onto the track portion.

In another embodiment, a launcher for a toy vehicle includes a base configured to support the launcher on a support surface and a housing coupled with the base. The housing includes a container in which a plurality of toy vehicles can be placed. In addition, the launcher includes a launching mechanism that launches a toy vehicle from within the housing in response to the housing and container being moved from a first position to a second position toward the base. The launching mechanism is configured to return to the first position to displace another toy vehicle into the launching position.

In one embodiment, the toy vehicles are disposed in a vertically stacked alignment within the container. Moreover, the container is pivotally coupled to the housing, which facilitates outward movement of the container from the housing during the loading of toy vehicles within the container. Moreover, a portion of the base is received within the housing when the container is moved to its second position.

BRIEF DESCRIPTION OF THE DRAWINGS

Like reference numerals have been used to identify like elements throughout this disclosure.

DETAILED DESCRIPTION OF THE INVENTION

It is to be understood that terms such as "left," "right," "top," "bottom," "front," "end," "rear," "side," "height," "length," "width," "upper," "lower," "interior," "exterior," "inner," "outer" and the like as may be used herein, merely described points or portions of reference and do not limit the present invention to any particular orientation or configuration. Further, terms such as "first," "second," "third," etc., merely identify one of a number of portions, components, and/or points of reference as disclosed herein, and do not limit the present invention to any particular configuration or orientation.

A toy vehicle launcher according to the present invention includes a first sidewall and a second sidewall that together form a launcher body. In this embodiment, the fronts or front portions of the sidewalls form part of a cavity for receiving and retaining a plurality of toy vehicles. The fronts of the sidewalls may have a cover pivotally attached to enable a user to access the cavity to position toy vehicles within the cavity. In other embodiments, the sidewalls may form a cavity in a location away from the fronts of the sidewalls. Furthermore, in this embodiment, the launcher includes a launching mechanism that, when activated, launches a toy vehicle from within the cavity while retaining the remaining toy cars within the cavity. In this embodiment, after the launcher launches the toy vehicle from within the cavity, it positions the next toy vehicle in position to be launched.

Figure 1:
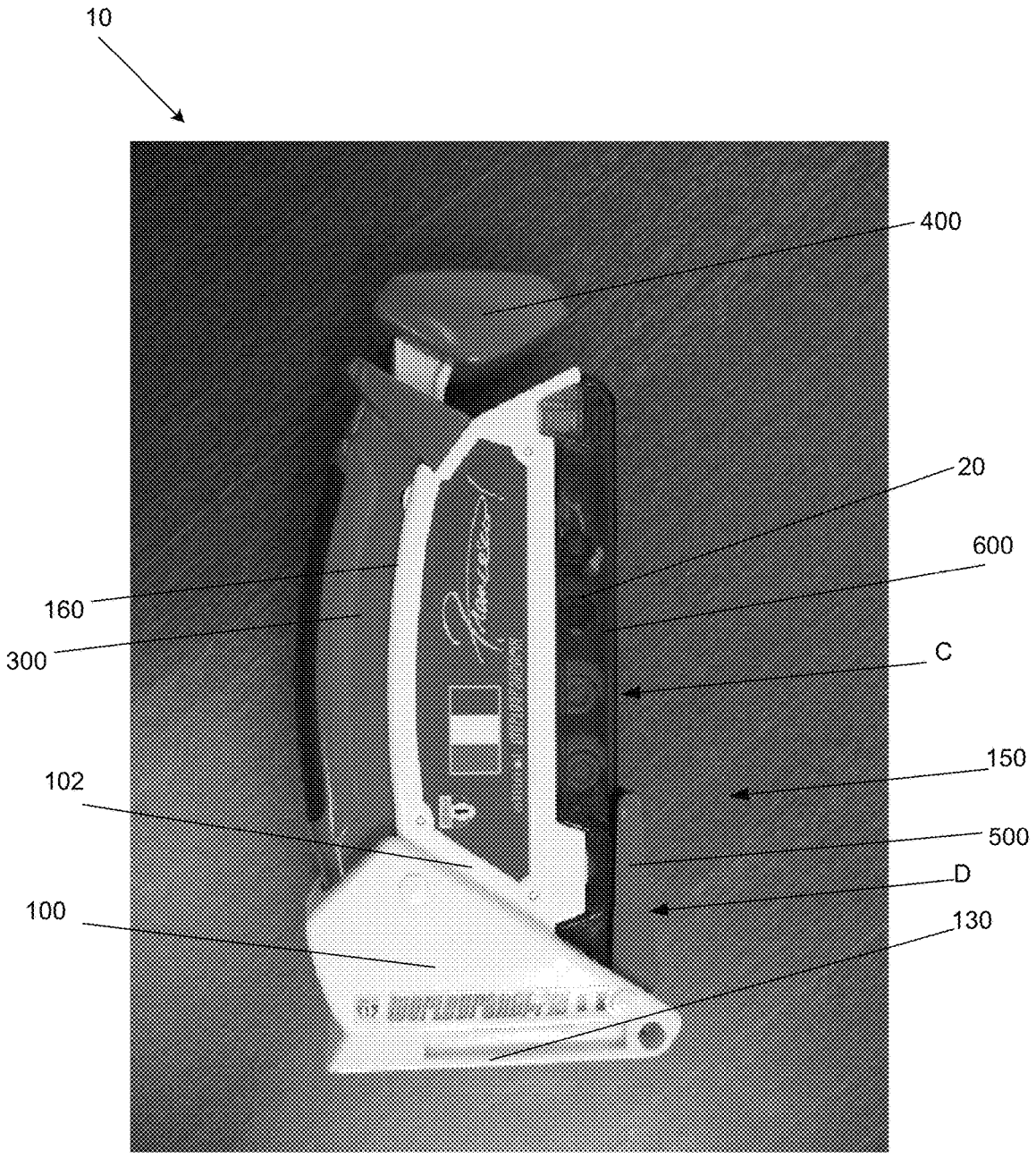
FIG. 1 illustrates a side view of one embodiment of a launcher according to the present invention.

FIG. 1 illustrates a side view of the launcher 10. Launcher 10 includes a first sidewall 100, a handle 300, and an actuator 400. First sidewall 100 includes an outer surface 102, a front 150, rear 160, and a base 130. Not illustrated in FIG. 1, is a second sidewall 200 (illustrated in FIG. 5) that is attached to the first sidewall 100 and is similar in size and shape to that of first sidewall 100. Pivotally attached to the base 130 and the front 150 of the first sidewall 100 is track 500. As illustrated, displaced on the rear 160 of the first sidewall 100 is handle 300.

Furthermore, actuator 400 extends upwardly from handle 300 and first sidewall 100. Cover 600 is attached to the front 150 of the first sidewall 100. In this embodiment, the cover 600 is transparent, however, the cover 600 may be opaque in other embodiments. Because the cover 600 is transparent, a user can view the toy cars 20 positioned inside the cover 600.

Figure 2:
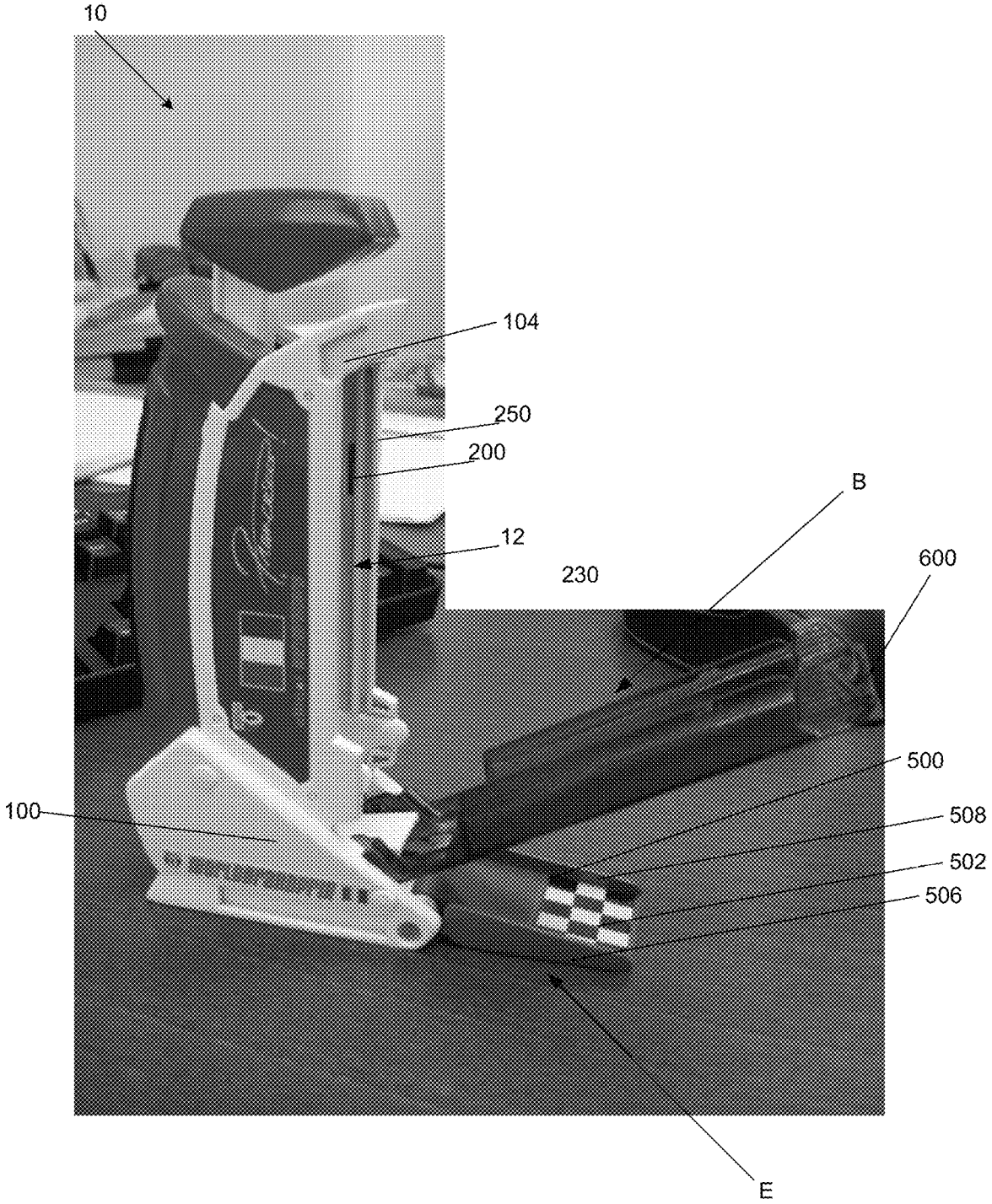
FIG. 2 illustrates a perspective view of the launcher of FIG. 1 with the track and cover placed in an open position.

Referring to FIG. 2, illustrated is a perspective view of the launcher 10 with the cover 600 and the track 500 pivoted into open positions. As illustrated in FIG. 2, the launcher 10 includes a first sidewall 100 and a second sidewall 200 opposite the first sidewall 100. Positioned between the front 150 of the first sidewall 100 and the front 250 of the second sidewall 200 is a channel 12. The cover 600 acts as a lid covering up the opening of the channel 12. As illustrated by FIG. 1 and FIG. 2, the cover 600 can pivot between a closed position C (as illustrated in FIG. 1) and an open position B (as illustrated in FIG. 2). As illustrated, the cover 600 pivots about an axis proximate to the base 130 of the first sidewall 100 and the base 230 of the second sidewall 200. When the cover 600 is in the open position B, the user is able to position a plurality of cars 20, in a vertical orientation, into the cavity 12 of the launcher 10. When the cover 600 is in the closed position C, the cover retains the cars 20 inside the cavity 12 of the launcher 10.

Continuing with FIGS. 1 and 2, the track 500 pivots between a stored positioned D and a deployed position E. Furthermore, as illustrated in FIG. 2, the track 500 includes a top 500, a first side 506, and a second side 508. When the track 500 is positioned in the stored position D, the track 500 prevents the cars 20 from being launched from the launcher 10. Moreover, when in the stored position D, the track 500 serves as a cap over the opening 606 (illustrated in FIG. 3) of the cover 600 where the cars 20 are launched out of. Referring back to FIG. 2, the track 500, when in the stored position D, prevents the cars 20 from falling out of the launcher 10 before they are launched. However, when the track 500 is in the deployed position E, the track 500 directs the cars 20 from the launcher 10 onto the support surface.

Figure 3:
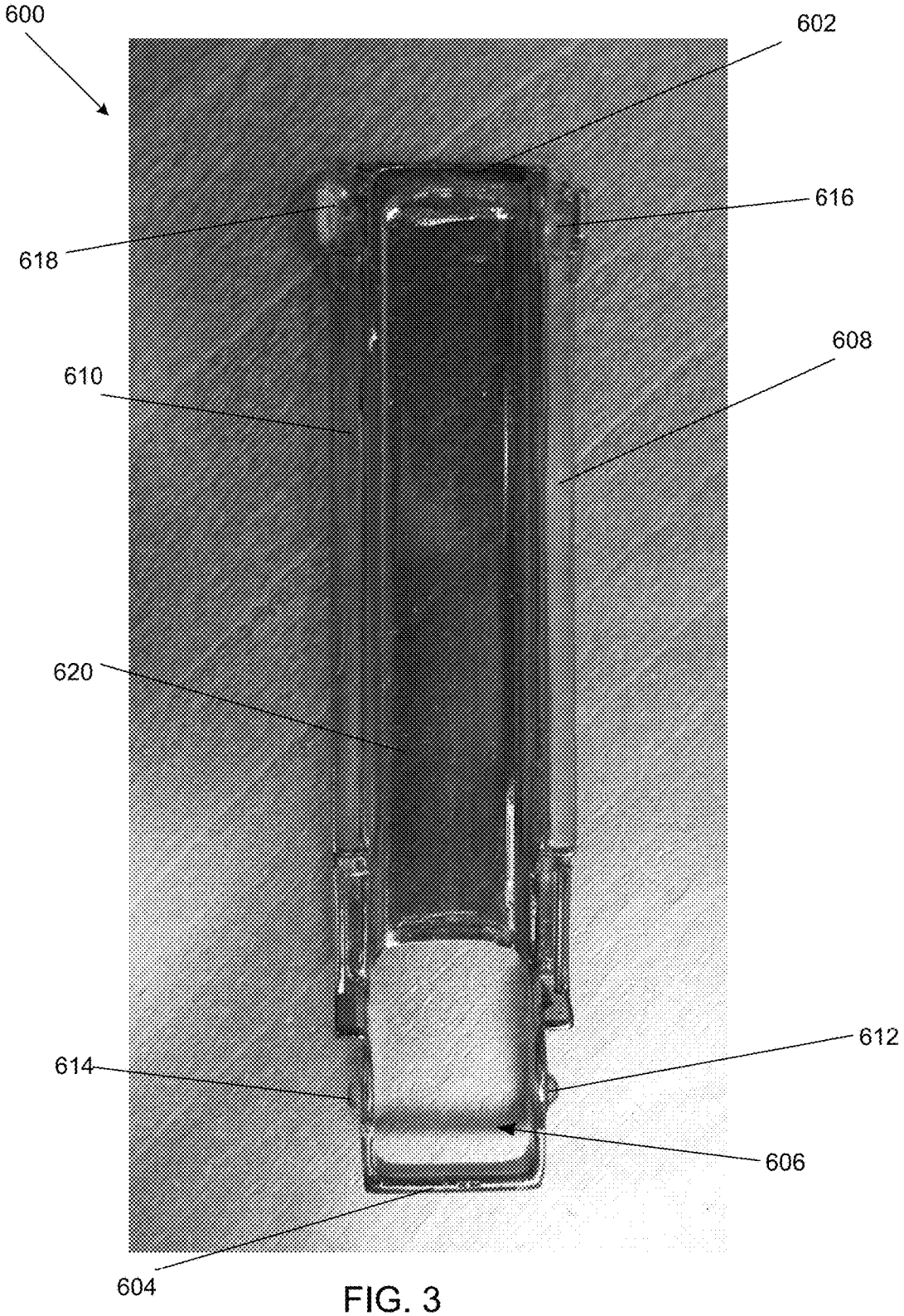
FIG. 3 illustrates a rear view of the cover of the launcher of FIG. 1 from the point of view from inside of the launcher.

Referring to FIG. 3, illustrated is an embodiment of the cover 600. Cover 600 includes a top 602, a bottom 604, a first side 608, and a second side 610, which collectively form a channel 620. Located at the bottom of the channel 620 proximate to the bottom 604 of the cover 600 is opening 606. Opening 606 is configured to allow cars 20 to be launched from within the cavity 12 of the launcher 10 through the opening 606 and onto the support surface. The first side 608 is configured to align with the outer surface 102 of the first sidewall 100. The second side 610 is configured to align with the outer surface 202 of the second sidewall 200. Moreover, the top 602 of the cover 600 is configured to align with the top 140 of the first sidewall 100 and the top 240 of the second sidewall 200. In addition, the channel 620 is configured to align with the cavity 12 of the launcher 10 in order to retain the cars 20 within the cavity 12 of the launcher 10.

Continuing with FIG. 3, the cover 600 includes a first protrusion 612 and a second protrusion 614. The first protrusion 612 extends from the first side 608 proximate to the bottom 604 of the cover 606. The second protrusion 614 extends from the second side 610 of the cover 600, proximate to the bottom 604 of the cover 606. The first protrusion 612 is configured to engage with the first sidewall 100 and the second protrusion 614 is configured to engage with the second sidewall 200. The protrusions 612, 614 enable the cover 600 to pivot with respect to the sidewalls 100, 200 about an axis in line with the protrusions 612, 614. Moreover, protruding from the first side 608, proximate to the top 602, is a first locking tab 616. First locking tab 616 is configured to engage with first locking tab receiver 104 (see FIG. 2) of the first sidewall 100 to lock the cover 600 in the closed position C. Protruding from the second side 610, proximate to the top 602, is a second locking tab 618. Second locking tab 618 is configured to engage with the second locking tab receiver 208 (see FIG. 4) of the second sidewall 200 to lock the cover 600 in the closed position C.

Figure 4:
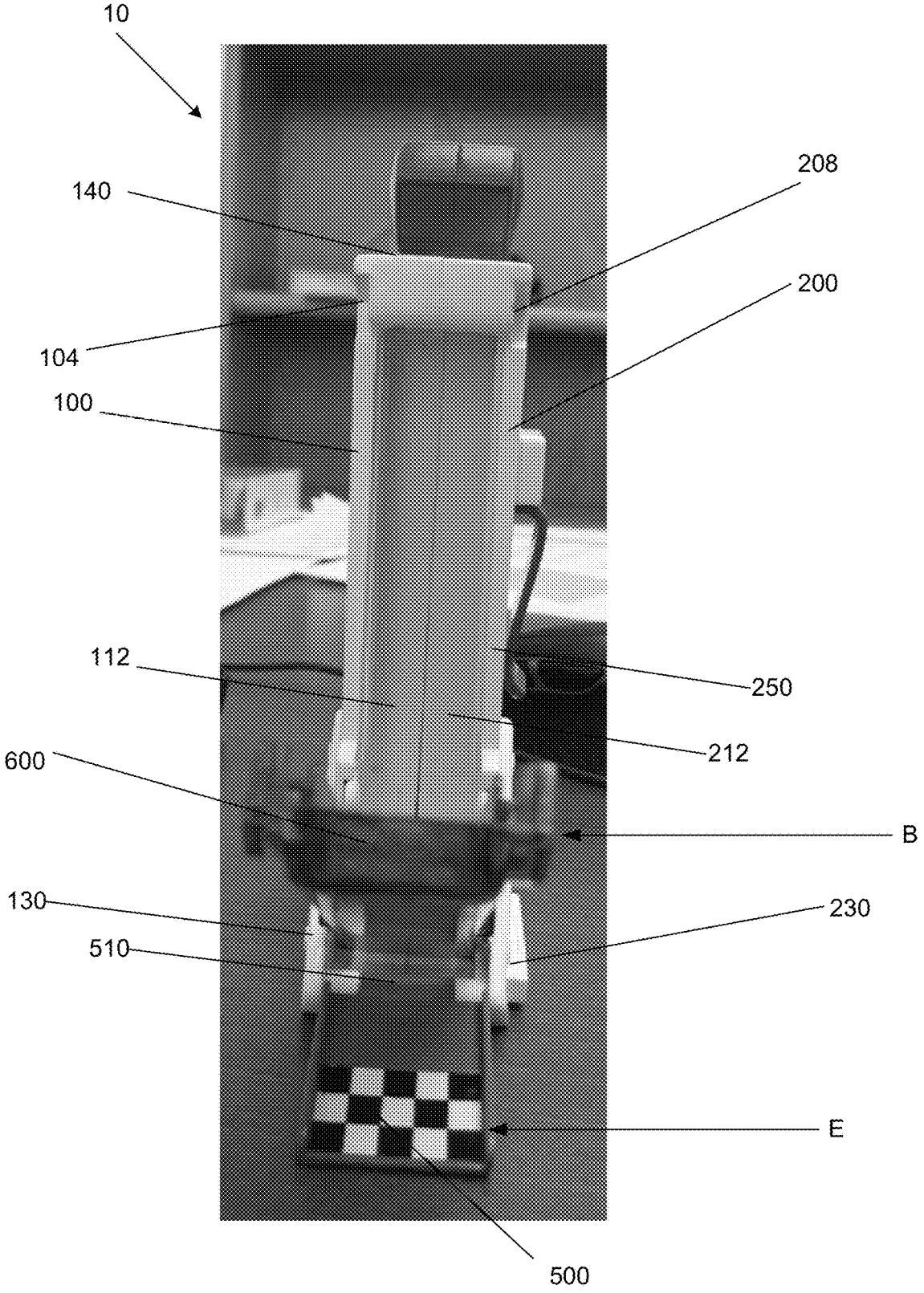
FIG. 4 illustrates a front view of the launcher of FIG. 1 with the track and cover placed in an open position.

Referring to FIG. 4, illustrated is a front view of the launcher 10 with the cover 600 pivoted into the open position B and the track 500 pivoted into the deployed position E. Furthermore, the cavity 12 of the launcher 10 is illustrated. Cavity 12 is outlined by the first sidewall 100 and the second sidewall 200. The first sidewall 100 includes a first half channel 112 and the second sidewall 200 includes a second half channel 212. First half channel 112 and second half channel 212, when adjacent to each other, form the cavity 12 of launcher 10. Located on the outer surface 202 of sidewall 200, proximate to the top 240, is second locking tab receiver 208. As discussed previously, locking tab receivers 104, 208 are configured to mate with locking tabs 616, 618 of cover 600 to retain the cover 600 in the closed position C.

Continuing with FIG. 4, track 500 is illustrated in the deployed position E. Track 500 further includes a pivot cylinder 510. Pivot cylinder 510 connects with the base 130 of first sidewall 100 and the base 230 of the second sidewall 200. The pivot cylinder 510 allows the track 500 to pivot about an axis along the pivot cylinder 510 between the stored position D and the deployed position E.

Figure 5:
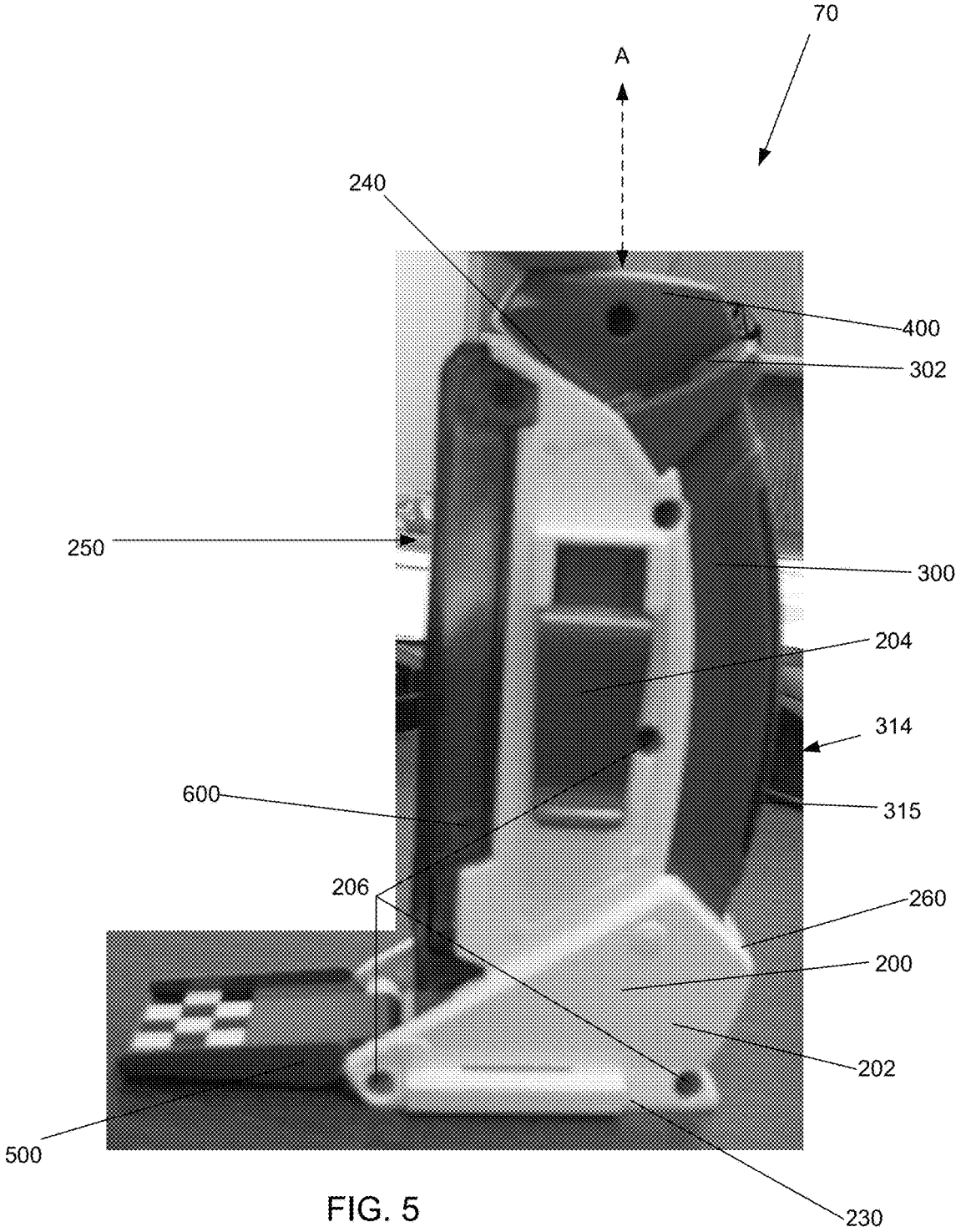
FIG. 5 illustrates another side view of the launcher of FIG. 1.

Referring to FIG. 5, illustrated is a side view of launcher 10 with a view of the second sidewall 200. Second sidewall 200 includes an outer surface 202 that includes a clip 204. Clip 204 is configured to engage a support structure, such as a belt or an article of clothing, to support the launcher 10. Furthermore, second sidewall 200 includes a front 250, a top 240, a base 230, and a rear 260. Moreover, second sidewall 200 includes a plurality of screw holes 206. The screw holes 206 are configured to receive screws to couple the second sidewall 200 to the first sidewall 100. In this embodiment, screws couple the first sidewall 100 and the second sidewall 200 together, however, in other embodiments, other means for coupling the two sides 100, 200 together may exist, such as locking tabs. Also illustrated in this embodiment is the cover 600 in the closed position C and the track 500 in the deployed position E.

In addition, FIG. 5 illustrates the path A in which actuator 400 travels to actuate the launching mechanism 700 (illustrated in FIGS. 10-17) within the launcher 10. In FIG. 5, the actuator is shown at the bottom of the path A, proximate to the top 240 of second sidewall 200 and the top 302 of the handle 300, where the launching mechanism 700 would be triggered to launch a car 20. Only when a user moves actuator 400 down the path A, in the position shown in FIG. 5, would the launching mechanism 700 be triggered. In other embodiments, the actuator 400 may be a lever that is pulled down. In addition, handle 300 includes a grip 315 disposed on the rear side 314. The grip 315 is configured to provide comfort to a user's hand when gripping the handle 300 of the launcher 10.

Figure 6:
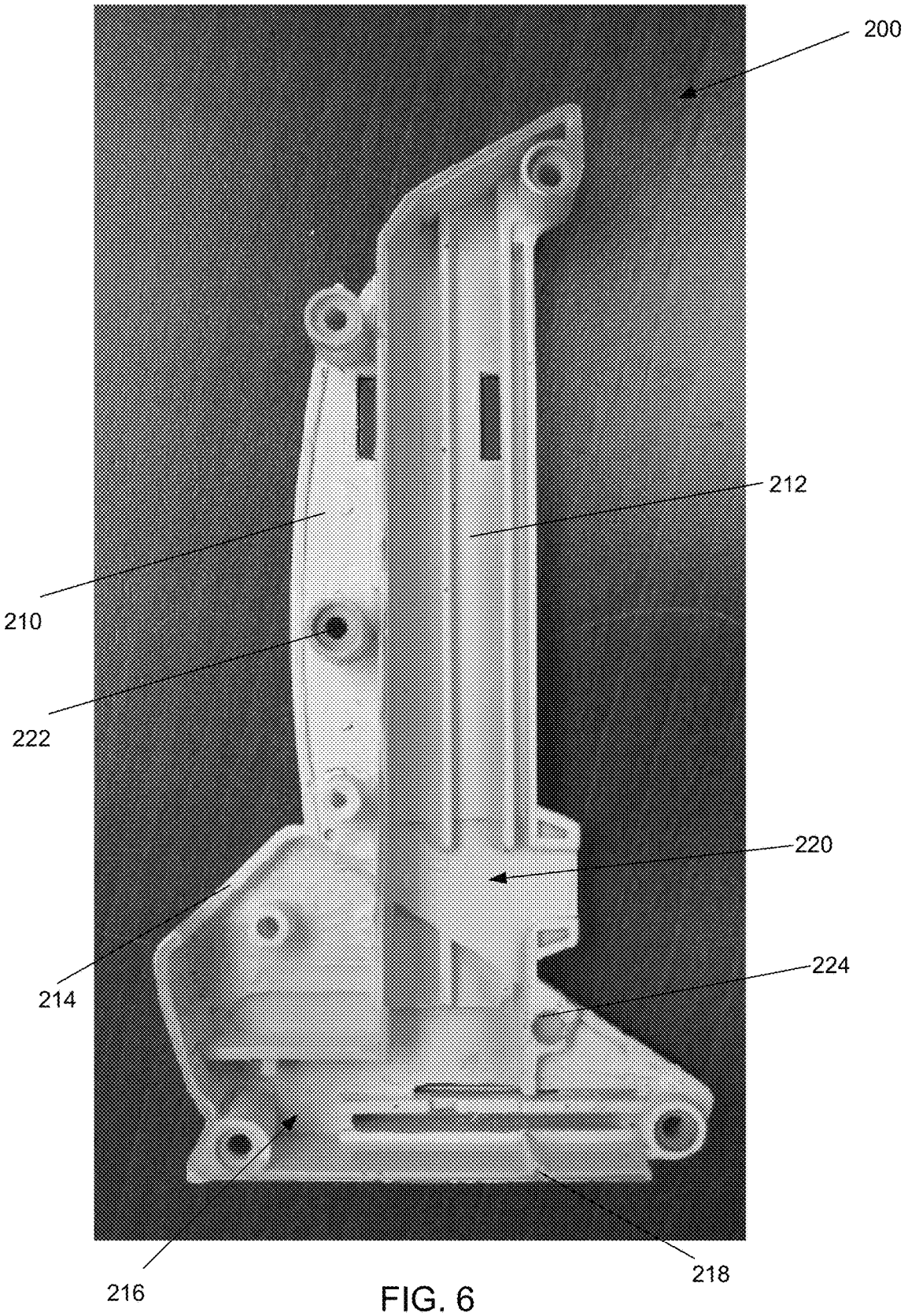
FIG. 6 illustrates a view of the inner wall or surface of the second sidewall of the launcher.

Referring to FIG. 6, illustrated is the inner wall or surface 210 of the second sidewall 200. Inner wall 210 includes a plurality of screw supports 222 that extend from the inner wall 210. These screw supports 222 align with the screw holes 206 on the outer wall 202 of the second sidewall 200. Furthermore, FIG. 6 illustrates the second half cavity 212, which forms half of the cavity 12. Below the second half cavity 212 is the launcher mechanism zone 216. This zone 216 is the location where the launcher mechanism 700 rests when the launcher 10 is fully assembled. The launcher mechanism zone 216 includes a retaining tab 218 that protrudes upward from the base 230 of the inner wall 210, and retains the launcher mechanism 700 within the launcher mechanism zone 216. The zone 216 further includes a claw resting area 220 located within the second half cavity 212. The claw resting area 220 is configured to enable the second claw 724 (illustrated in FIGS. 10 and 11) to rest along the inner wall 210 of the second sidewall 200, while still allowing the cars 20 to move vertically within the cavity 12 of the launcher 10.

Figure 15:
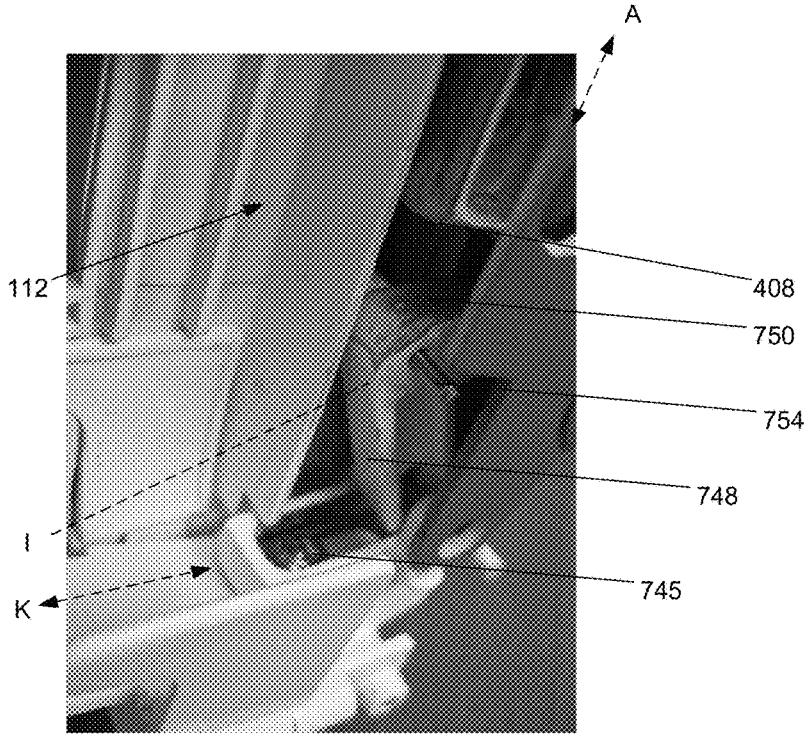
FIGS. 15 and 16 illustrate perspective views of a portion of the launcher of FIG. 1 with the launching mechanism in a loaded position and in a deployed position, respectively.
Figure 16:
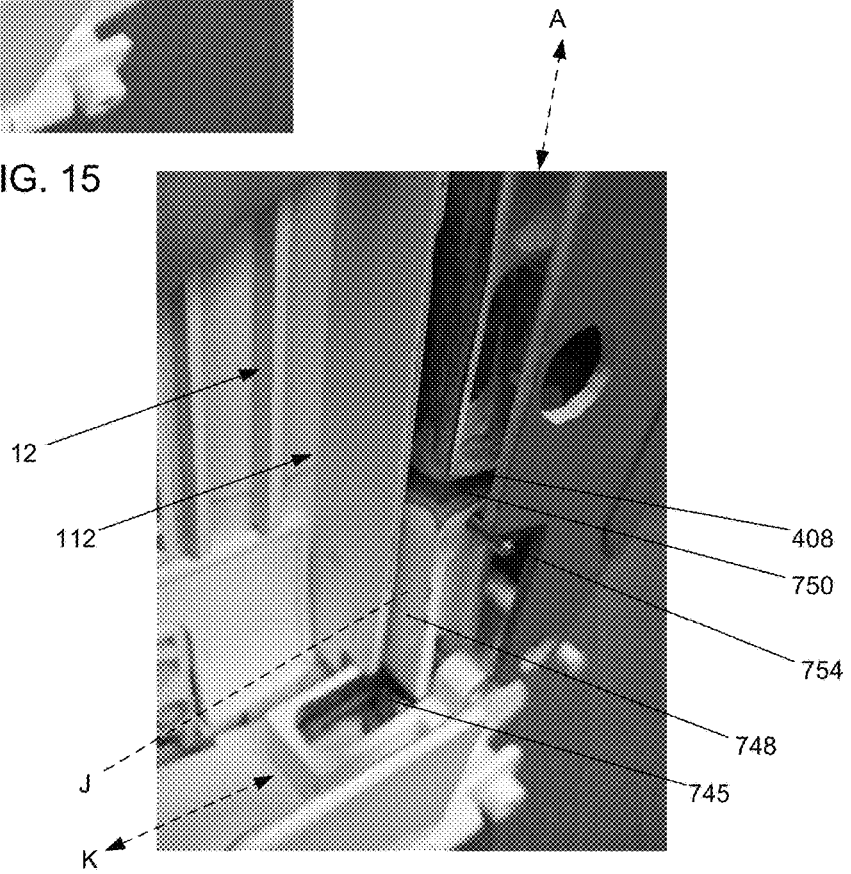

Continuing with FIG. 6, the rear 260 of the inner wall 210 includes a cutaway 214. The cutaway 214 enables the actuator 400 and the handle 300 to be received by the second sidewall 200. Furthermore, the cutaway 214 enables the actuator 400 to engage with the launching mechanism as illustrated in FIGS. 15 and 16. In addition, inner wall 210 includes a protrusion receiver 224. The protrusion receiver 224 is configured to engage the second protrusion 614 of the cover 600, enabling the cover 600 to rotate about an axis in line with the protrusion receiver 224.

Figure 7:
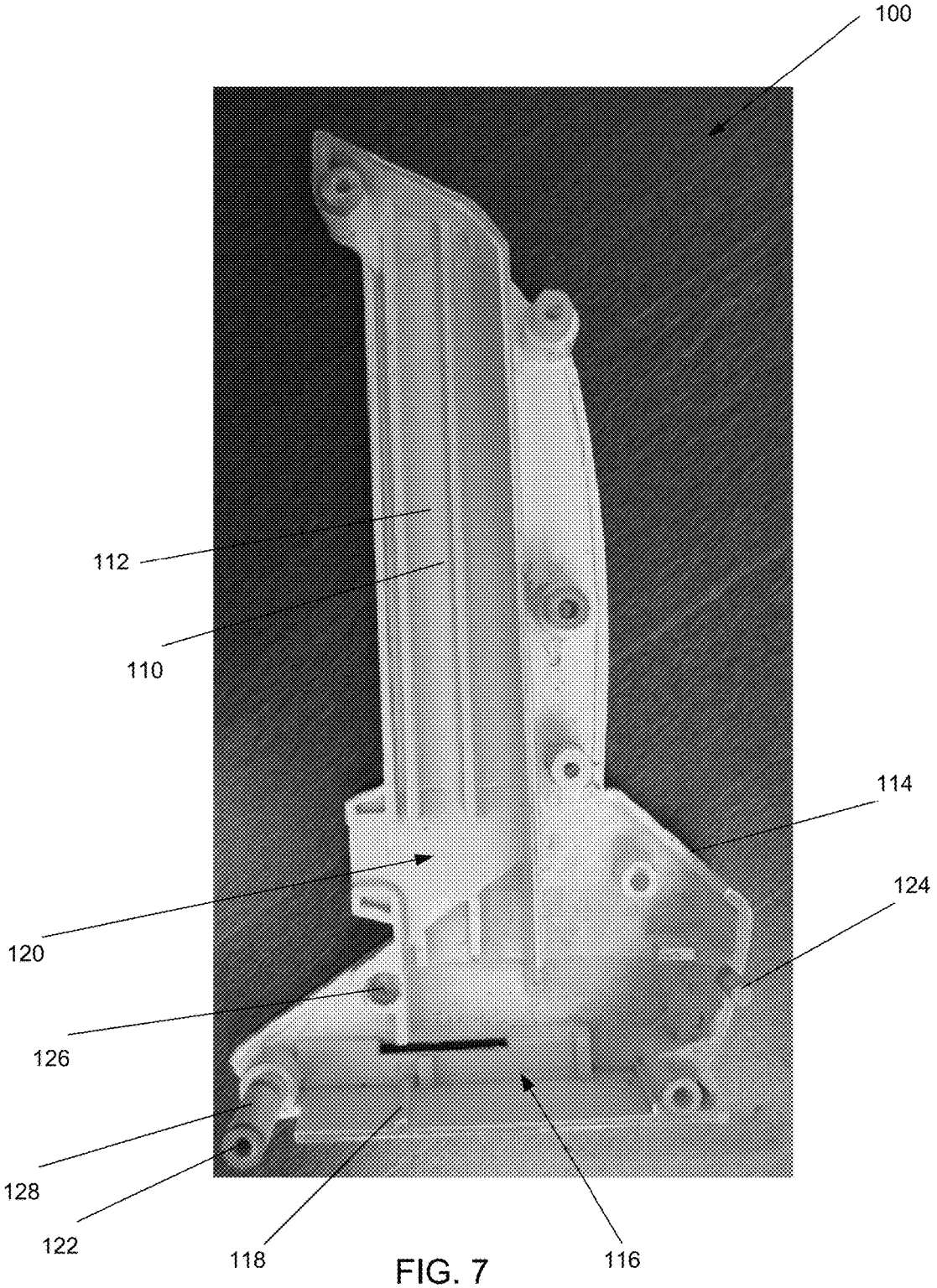
FIG. 7 illustrates a view of the inner wall or surface of the first sidewall of the launcher.

Referring to FIG. 7, illustrated is the inner wall or surface 110 of the first sidewall 100. Inner wall 110 includes a plurality of screw receivers 122 that extend from the inner wall 110. These screw receivers 122 align with the screw supports 222 on the inner wall 210 of the second sidewall 200. The first half cavity 112 is illustrated near the front 150 of the first sidewall 100, which, together with second half cavity 212, forms the cavity 12. Below the first half cavity 112 is the launcher mechanism zone 116. This zone 116 is the location within the first sidewall 100 that the launcher mechanism 700 rests when the launcher 10 is fully assembled. The launcher mechanism zone 116 includes a retaining tab 118 that protrudes upward from the base 130 of the inner wall 110, and retains the launcher mechanism 700 within the launcher mechanism zone 116. The zone 116 further includes a claw resting area 120 located within the first half cavity 112. The claw resting area 120 is configured to enable the first claw 716 (illustrated in FIGS. 10 and 11) to rest along the inner wall 110, while still allowing the cars 20 to move vertically within the cavity 12 of the launcher 10. When the first sidewall 100 and the second sidewall 200 are coupled to each other, the launcher mechanism zone 116 of the first sidewall 100 aligns with the launcher mechanism zone 200 of the second sidewall 200.

Continuing with FIG. 7, the rear 160 of the inner wall 110 includes a cutaway 114. The cutaway 114 enables the actuator 400 and the handle 300 to be received by the first sidewall 100. Furthermore, the cutaway 114 enables the actuator 400 to engage with the launching mechanism 700 (illustrated in FIGS. 15 and 16). In addition, inner wall 110 includes a protrusion receiver 126. The protrusion receiver 126 is configured to engage the first protrusion 612 of the cover 600, enabling the cover 600 to rotate about an axis in line with the protrusion receiver 126. Moreover, a track support cylinder 128 extends from the inner wall 110. Track support cylinder 128 is configured to slidably receive the pivot cylinder 510 of the track 500 over the track support cylinder 128, and enable the track 500 to pivot about the support cylinder 128. The support cylinder 128 is configured to fit within the pivot cylinder 510. In addition, a spring support bar 124 extends from the inner wall 110 proximate the rear 160 of the first sidewall 100. The spring support bar 124 is configured to receive a recoil spring 740 of the launching mechanism 700 (illustrated in FIG. 17).

Figure 8:
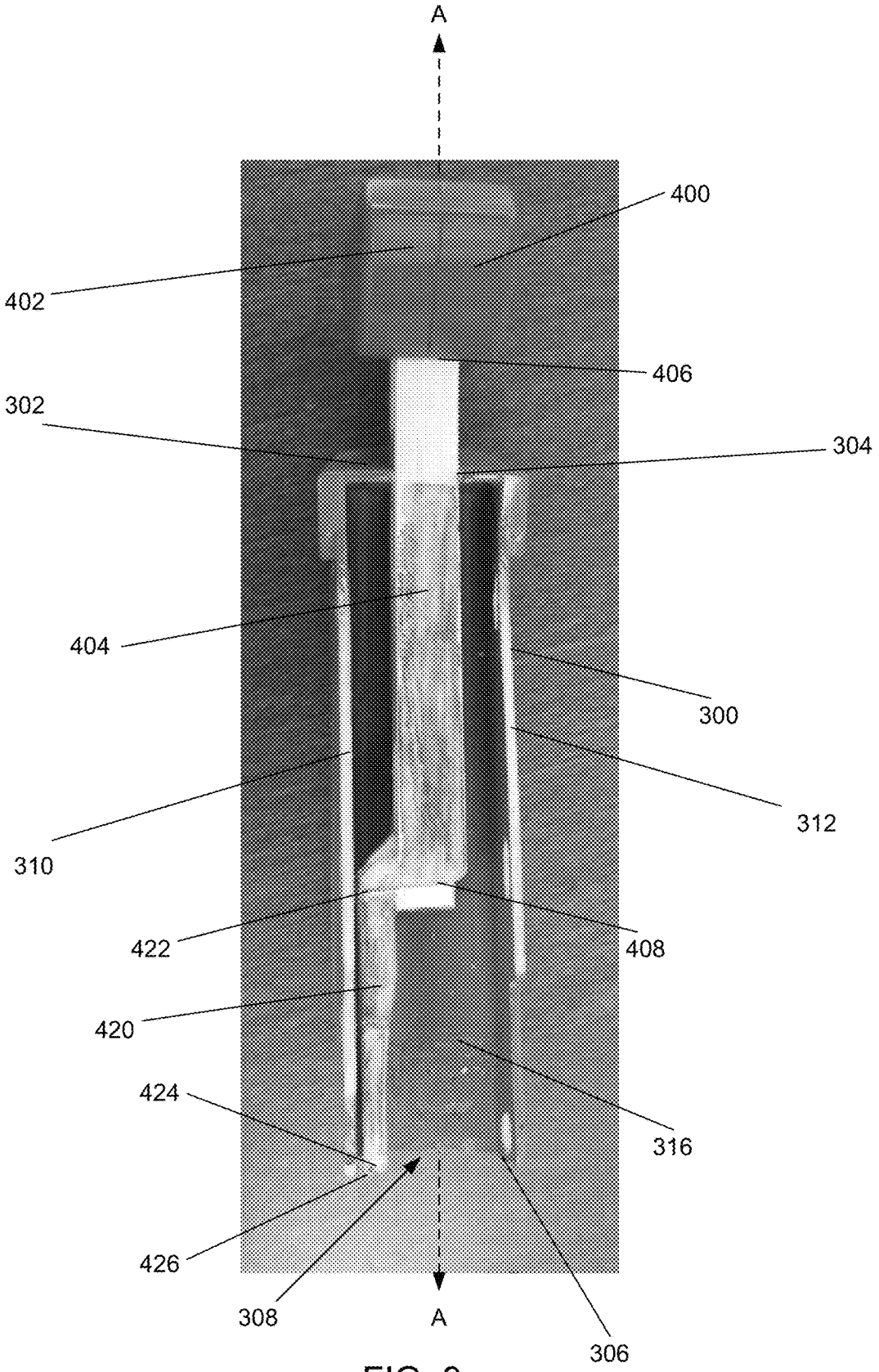
FIG. 8 illustrates the handle and the actuator of the launcher in FIG. 1.

Referring to FIG. 8, illustrated is the inner surface 316 of the handle 300 with actuator 400. As illustrated, handle 300 includes a top 302, a bottom 306, a first side 310, and a second side 312. Handle 300 also includes an opening 304 in the top 302 and an aperture 308 in the bottom 306. The opening 304 and the aperture 308 are configured to enable the actuator 400 to move along the actuation path A. The actuator 400 includes a first section 404 and a second section 420. The first section 404 includes a top 406 and a bottom 408. Attached to the top 406 of the first section 404 is a button 402. The bottom 408 of the first section 404 is attached to the top 422 of the second section 420. Second section 420 also includes a bottom 424 with an impacter or engager 426.

Figure 9:
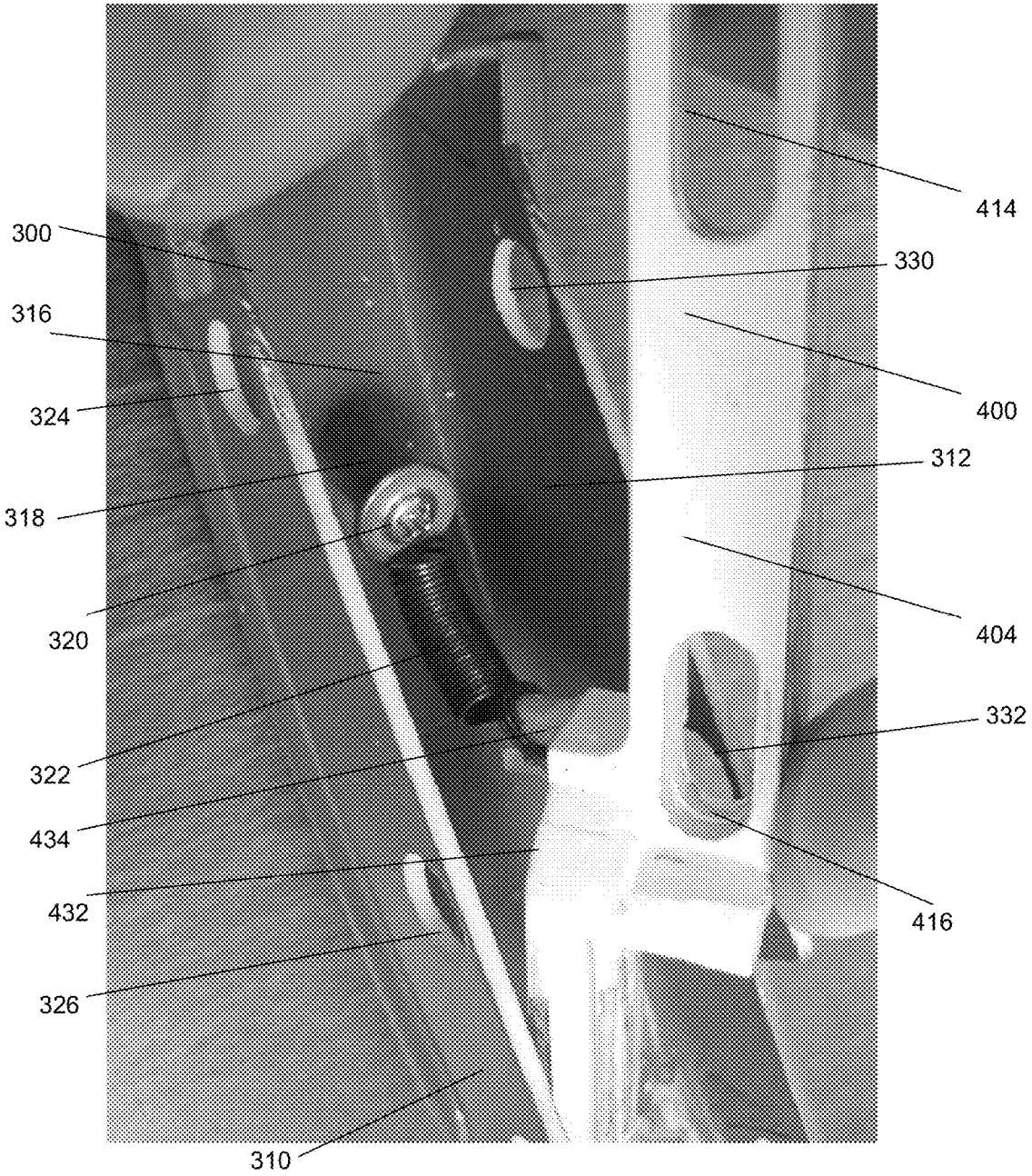
FIG. 9 illustrates a perspective view of connection between the actuator and the cover.

Referring to FIG. 9, the connection between the handle 300 and the actuator 400 is illustrated. Cover 300 includes an inner surface 316 on the rear side 314. Attached to the inner surface 316 is a screw receiver 318. Illustrated on the rear 432 of the first section 404 of the actuator 400 is a hook 434. As illustrated, a spring 322 is attached to the screw receiver 318 by screw 320 and the hook 434. The spring 322 serves to couple the actuator 400 to the handle 300 while also returning the actuator 400 to a loaded position along actuation path A when the actuator 400 is depressed.

Continuing with FIG. 9, the handle 300 includes a first side 310 and a second side 312. From FIG. 9, it can be seen that first side 310 includes a first upper opening 324 and a first middle opening 326. It can be seen that second side 312 includes a second upper opening 330 and a second middle opening 332. Furthermore, as illustrated in FIG. 9, there is a first aperture 414 and a second aperture 416 in the first section 404. The first aperture 414 aligns with the first and second upper openings 324, 330 and with one of the screw supports 222 and one of the screw receivers 122. In addition, the second aperture 416 aligns with the first and second middle openings 326, 332 and with one of the screw supports 222 and one of the screw receivers 122. This alignment provides extra support of the handle 300, along with the retaining of the handle 300 with the launcher 10. Additionally, as illustrated, in this embodiment, the first and second apertures 414, 416 are elongated, to allow the actuator 400 to move along the actuation path A while still allowing passage of the screw supports 222 in the slots.

Figure 10:
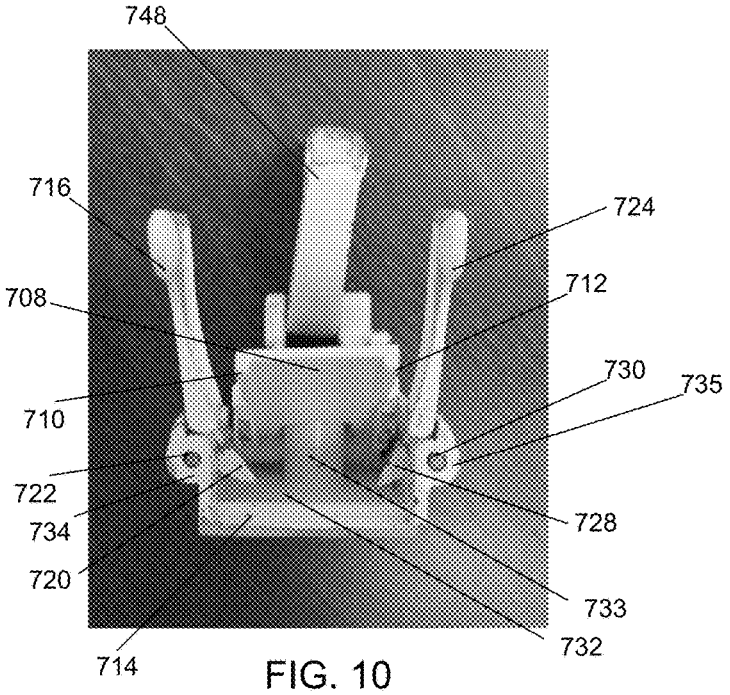
FIGS. 10 and 11 illustrate front and rear views, respectively, of a portion of the launcher in a first configuration.
Figure 11:
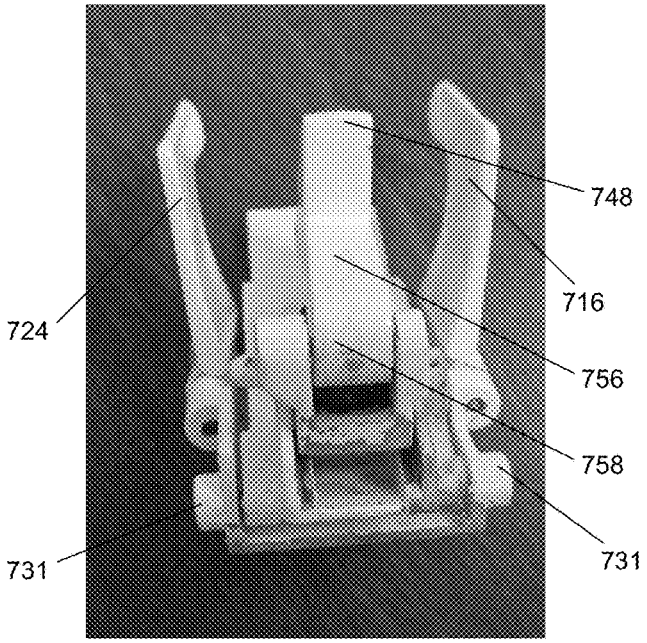

Referring to FIGS. 10 and 11, illustrated is a front view (FIG. 10) and a rear view (FIG. 11) of the launching mechanism 700. The launching mechanism includes a claw holder 714 that includes a bottom 732 with a first claw cylinder 734, a second claw cylinder 735, and ramp cylinders 731 positioned along the sides of the claw holder 714. In this embodiment, the ramp cylinders 731 are positioned proximate the rear of the claw holder 714, with the first and second claw cylinders 734, 735 positioned between the front of the claw holder 714 and the ramp cylinder 731. The bottom 732 of claw holder 714 further includes a screw receiver 733.

Figure 12:
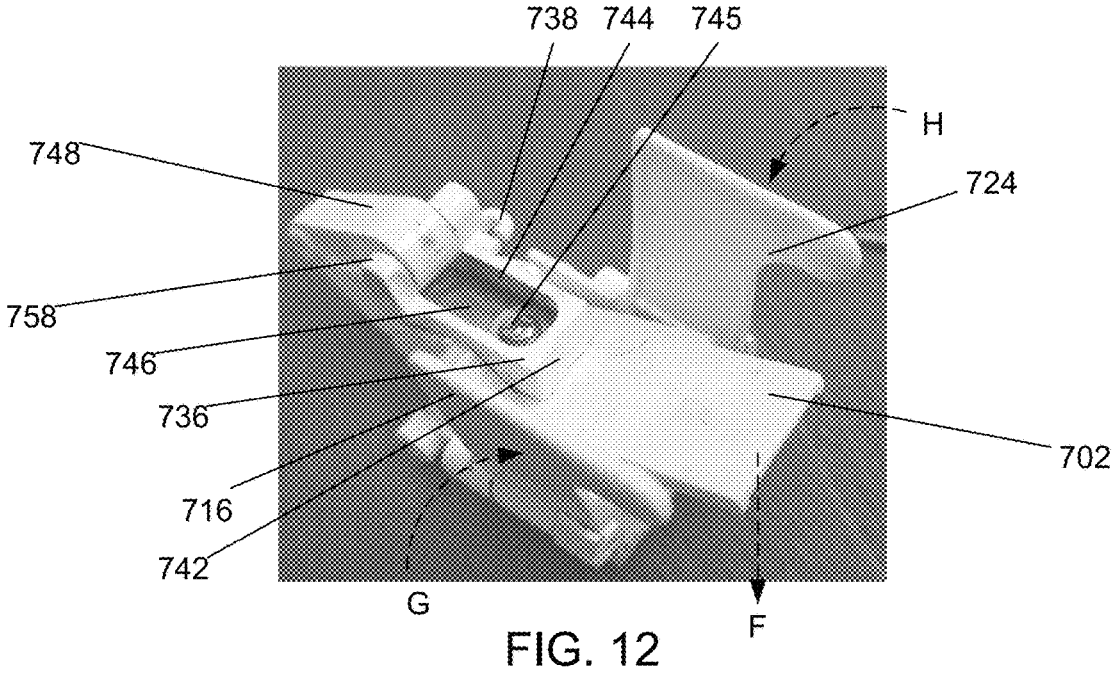
FIGS. 12 and 13 illustrate perspective views of a portion of the launcher in different configurations showing the positions of the claw members.
Figure 13:
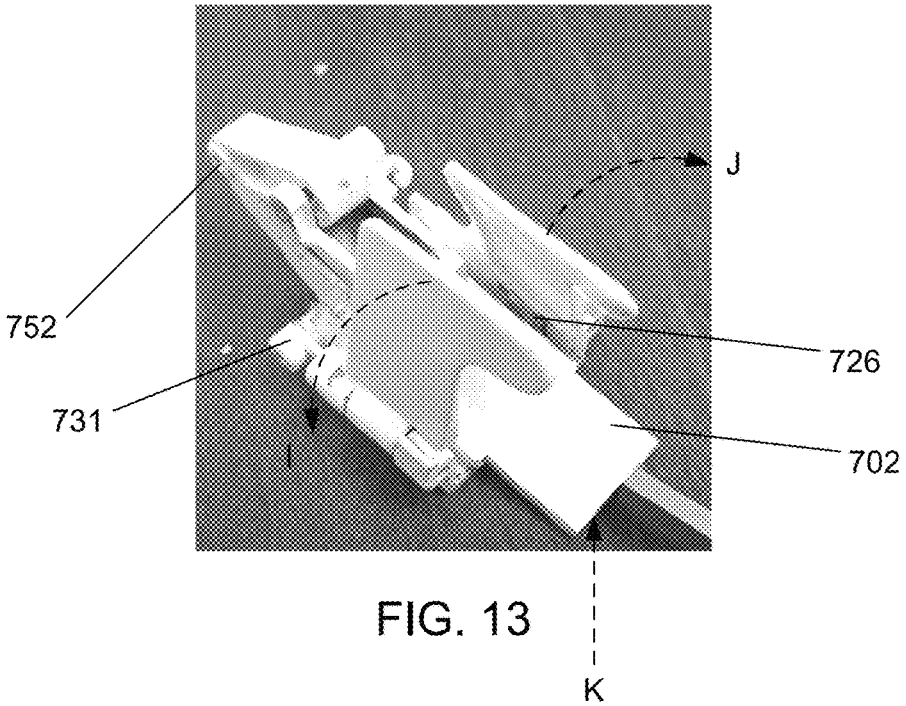

Referring to FIGS. 12 and 13, rotatably coupled to the ramp cylinders 731 is ramp 702 that has a top and a bottom 708. The top of the ramp 702, proximate to the ramp cylinders 731 is an impact surface. In this embodiment, the bottom 708 of the ramp 704 includes a first push protrusion 710 and a second push protrusion 712.

Continuing with FIGS. 10 and 11, a first claw 716 is rotatably coupled to the first claw cylinder 734 by pin 722 and a second claw 724 is rotatably coupled to the second claw cylinder 735 by pin 730. Protruding from the bottom of the first claw 716 is a first push tab 720 and protruding from the bottom of the second claw 724 is a second push tab 728. The push tabs 720, 728 are positioned to extend underneath the bottom 708 of the ramp 702, and are configured for the first push tab 720 to be in line vertically with the first protrusion 710 and second push tab 728 to be in line vertically with the second protrusion 712.

Referring to FIGS. 12 and 13, illustrated is the movement relationship between the first claw 716, the second claw 724, and the ramp 702 of the launching mechanism 700. As illustrated in FIG. 12, the first claw 716 rotates inward along path G and the second claw 724 rotates inward along path H, which results in the two claws 716, 724 rotating toward each other. The ramp 702 rotates downwardly, along path F, toward the bottom 732 of the claw holder 714 as the ramp 702 is engaged. As the ramp 702 rotates downward along path F, the first and second push protrusions 710, 712 contact the first and second push tabs 722, 730, respectively. The protrusions 710, 712 push downwardly on the push tabs 722, 730, causing the claws 716, 724 to rotate along paths G and H.

FIG. 13 illustrates the positions that the ramp 702, first claw 716, and second claw 724 rotate into when a downward force is applied to the ramp 702. As illustrated by FIG. 13, when the downward force applied to the ramp 702 is removed from the ramp 702, the ramp is raised along path K, allowing the first claw 716 to rotate outwardly along path I and the second claw 724 to rotate outwardly along path J. The first claw includes a spring 718 (illustrated in FIG. 14) and the second claw includes a similar spring 726 (see FIG. 13). The springs 718 cause the claws 716, 724 to rotate outwardly along paths I and J, returning to their original positions, when the load is removed from the ramp 702.

Continuing with FIGS. 12 and 13, the impact surface 706 is configured to be engaged by the impacter or engager 426 (illustrated in FIG. 8). When the actuator 400 is depressed along actuation path A, the impacter 426 depresses on the impact surface 706, pushing the ramp downward along path F. As described previously, when ramp 702 is rotated downwardly along path F, the ramp 702 engages the first and second claws 716, 724, rotating them inwardly about paths G and H. The claws 716, 724 grasp the car 20 positioned vertically above the car 20 positioned on the top 704 of the ramp 702.

Continuing with FIGS. 12 and 13, slidably connected to the launching mechanism 700 is the hammer 736. Hammer 736 includes a striking member 742 and a channel 744. Channel 744 includes an aperture 746 and is configured to receive a screw 745 that screws into the screw receiver 733 (illustrated in FIG. 10). Located proximate to the rear of the hammer 736 is a hook 738. As illustrated in FIGS. 10-13, pivotally coupled to the hammer 736 is the push lever 748. Push lever 748 includes an arm 756 and a top with a stationary connection 752 (see FIG. 13), which pivotally connects the push lever 748 to the first sidewall 100 and second sidewall 200 (illustrated in FIGS. 15 and 16). Extending downwardly from the top is arm 756, which is pivotally coupled to the hammer 736 via hammer connection 758 (see FIGS. 11 and 12).

Figure 14:
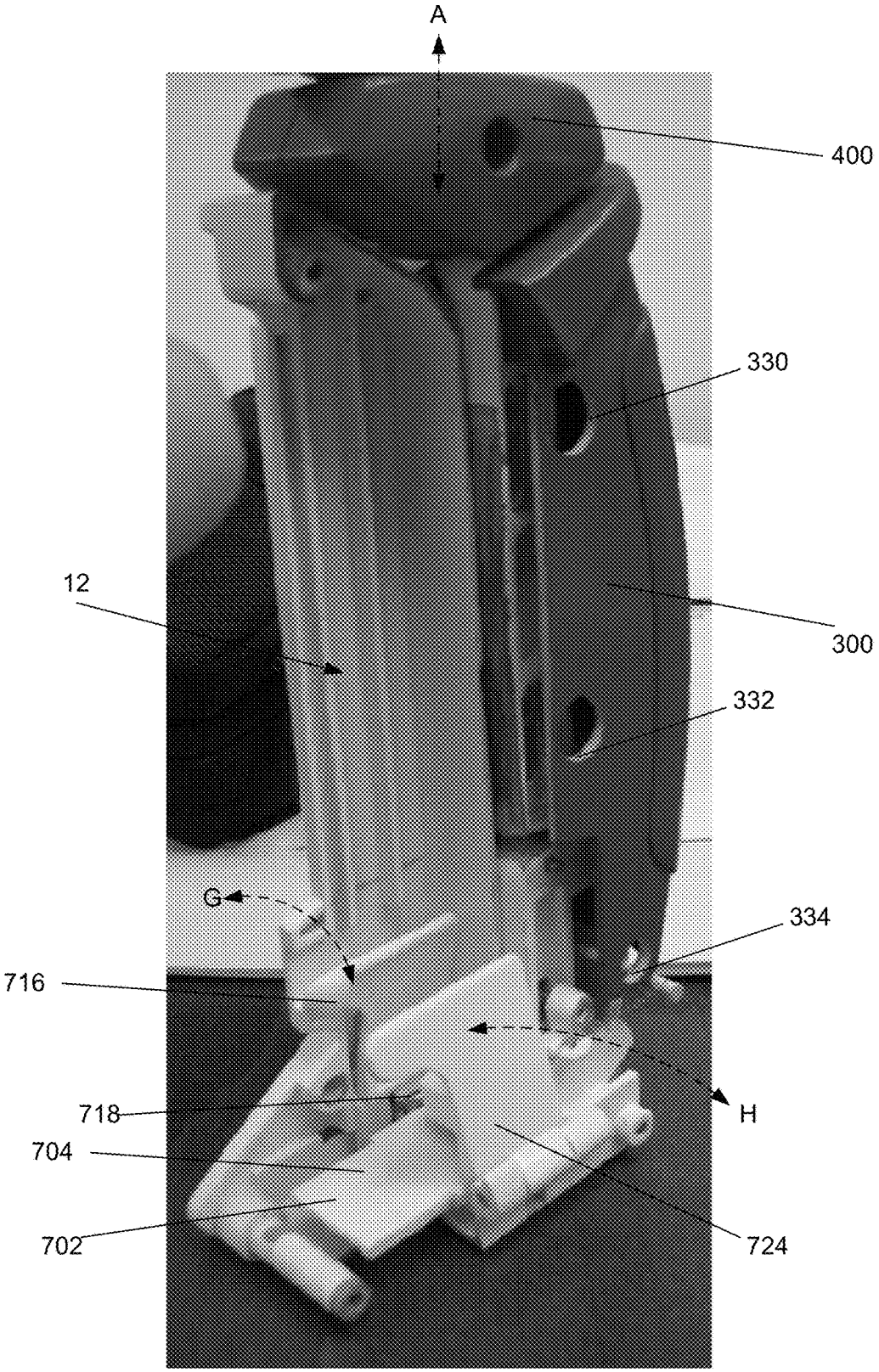
FIG. 14 illustrates a perspective view of the launcher of FIG. 1 with one of the sidewalls removed and showing the inner working relationship between the actuator, the side wall, and the launching mechanism.

Referring to FIG. 14, the launcher 10 with second sidewall 200 is illustrated removed, revealing the interconnection of the actuator 400 with the launching mechanism 700 and the first sidewall 100. As illustrated, the actuator 400 has been pressed downwardly along path A, actuating the launching mechanism 700. As stated previously, the cars 20 rest within the cavity 12 in a vertical orientation. The car 20 that is to be launched next rests along the top 704 of the ramp 702 in the launching position.

FIG. 14 illustrates that when the actuator 400 is depressed along path A, the first claw 716 and the second claw 724 are rotated inwardly along paths G and H. The first claw 716 and the second claw 724 are configured to grab a second car 20 that would be positioned above a first car 20 that is in the launching position. Once the first car 20 is launched from the launching position, the claws 716, 724 are configured to release the second car 20, dropping it onto the top 704 of the ramp 702 into the launching position. When the claws 716, 724 release the car 20, the claws rotate outwardly along paths G, H and into the claw resting areas 120, 220 on the inner walls 110, 210 of the sidewalls 100, 200.

Continuing with FIG. 14, handle 300 is illustrated with second upper opening 330, second middle opening 332, and second lower opening 334 on the second side 312. Furthermore, the second upper opening aligns with first upper opening 324 (illustrated in FIG. 9). The second middle opening aligns with the first middle opening 326 (illustrated in FIG. 9). The second lower opening aligns with the first lower opening (not illustrated). The first upper opening 324, first middle opening 326, and first lower opening 328 are disposed on the first side 310 of the handle 300. The first openings 324, 326, 328 and the second openings 330, 332, 334, as discussed previously, align with, and receive several of the screw supports 222 and the screw receivers 122 to provide support and couple the handle 300 to the launcher 10.

Referring to FIGS. 15 and 16, the movement of the actuator 400 with respect to the push lever 748 and hammer 736 of the launching mechanism 700 is illustrated. As shown, the push lever 748 is positioned behind the first half cavity 112 and the second half cavity 212 (not illustrated in FIGS. 15 and 16). Furthermore, the hammer 736 is slidable along path K between a launched position, and a loaded position. The hammer 736 is positioned behind the first half cavity 112 and the second half cavity 212 (not illustrated in FIGS. 15 and 16) when in the hammer 736 is in a loaded position. The hammer 736 is extended into the cavity 12, formed by first half cavity 122, and second half cavity 212 (not illustrated in FIGS. 15 and 16), when the hammer 736 is in a launched position. The channel 744 with the aperture 746 and the screw 745 are configured for the hammer 736 to slide the length of the aperture 746 along path K with the screw 745 remaining stationary within aperture 746. The stationary screw 745 within the aperture 746 defines the limits for which the hammer 736 can slide along path K.

Continuing with FIGS. 15 and 16, the push lever 748 is illustrated in loaded position I and in launch position J. Push lever 748 in loaded position I has a gap between the top 750 of the push lever 748 and the bottom 408 of the first section 404 of the actuator 400. The stationary connection 752 of the top 750 of the push lever is connected to the first sidewall 100 and second sidewall 200 by pin 754. When the push lever 748 is in loaded position I, the hammer 736 is positioned in a loaded position along the path K.

As illustrated in FIG. 16, when the actuator 400 is pushed downwardly along path A, the bottom 408 of first section 404 of the actuator 400 contacts the top 750 of the push lever 748, pivoting the push lever 748 about stationary connection 752 into launch position J. When push lever 748 is pivoted into position J, the hammer 736 slides along path K, extending into the cavity 12, striking the car 20 that is positioned on the top 704 of the ramp 702 with striking member 742.

Figure 17:
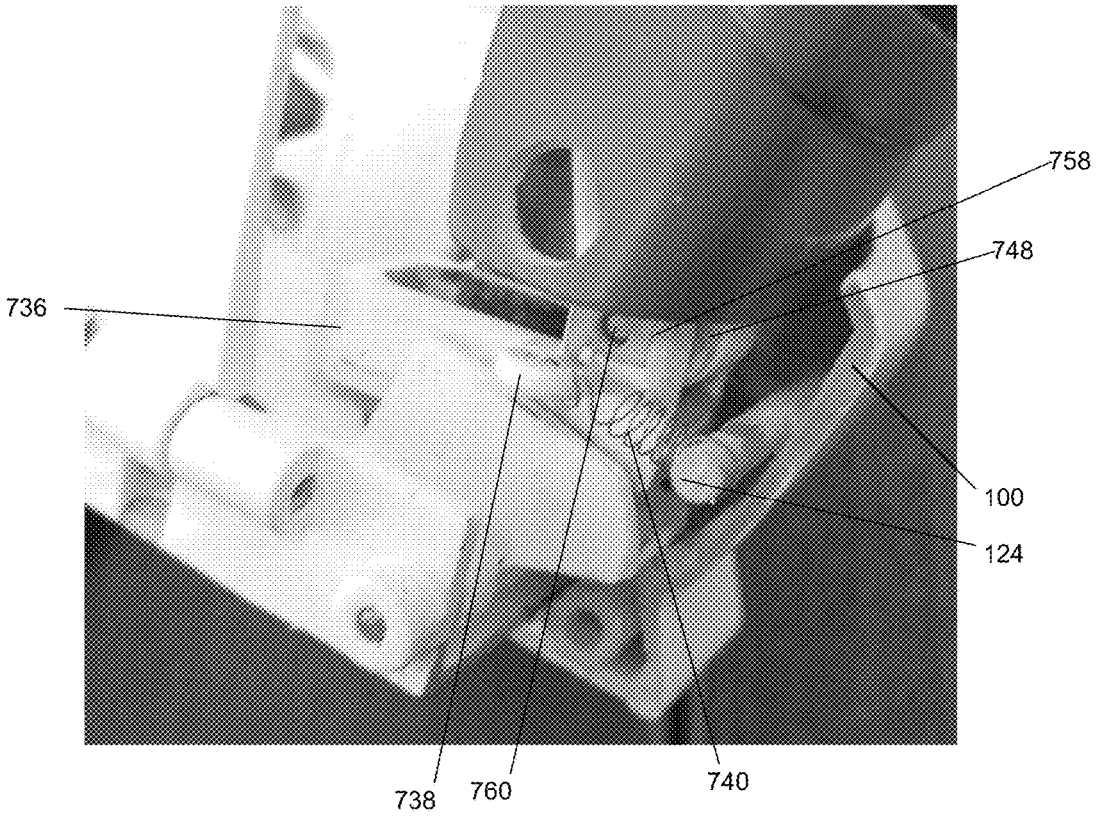
FIG. 17 illustrates a perspective view of the launching mechanism of the launcher of FIG. 1 and the reloading interaction with the sidewall of FIG. 7.

Referring to FIG. 17, illustrated is another perspective of the launching mechanism 700 positioned within the first sidewall 100. As illustrated in FIG. 17, push lever 748 is pivotally coupled to the hammer 736 at hammer connection 758 via pin 760. Furthermore, proximate to the rear of the hammer 736 and the hammer connection 758 is hook 738. A recoil spring 740 connects hook 738 of hammer 736 to the spring support bar 124 of the first sidewall 100. Recoil spring 740 is configured to return hammer 736 to a loaded position along path K after the launching mechanism 700 has been triggered by actuator 400. As discussed previously, when the actuator 400 is pushed downwardly along path A, the bottom 408 of first section 404 of the actuator 400 contacts the top 750 of the push lever 748, pivoting the push lever 748 into launch position J, which in turn slides the hammer 736 along path K, and extends the recoil spring 740. When actuator 400 is released, the spring 322, which couples the actuator 400 to the handle 300, raises the actuator 400 along actuation path A (not illustrated in FIG. 17). Simultaneously, the recoil spring 740 slides the hammer 736 along path K towards the rear of the first sidewall 100, returning the hammer 736 to the loaded position.

Figure 18:
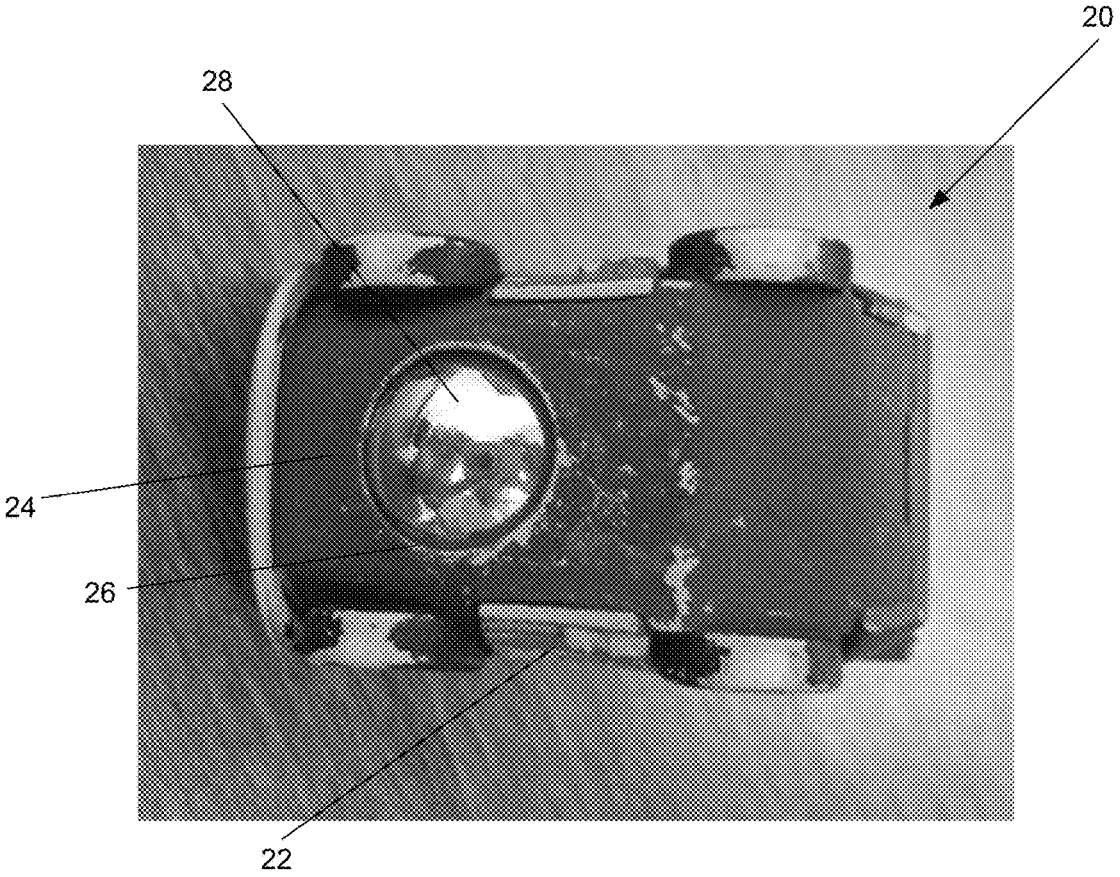
FIG. 18 illustrates a bottom view of a toy vehicle with a ball bearing.

Referring to FIG. 18, illustrated is an embodiment of the car 20. In this embodiment, car 20 includes a cover 22 and a base 24. In other embodiments, the car may consist of a single material. Furthermore, base 24 includes an opening 26. Opening 26 is configured to receive a ball bearing 28 that fits within a cavity formed by cover 22 and base 24. The ball bearing 28 is configured to allow the car 20 to travel across a support surface.

Although the disclosed inventions are illustrated and described herein as embodied in one or more specific examples, it is nevertheless not intended to be limited to the details shown, since various modifications and structural changes may be made therein without departing from the scope of the invention and within the scope and range of equivalents of the claims. For example, although the illustrated embodiments are shown with a launcher having a cavity built into the body of the launcher, capable of receiving toy vehicles, and being enclosed by a cover, the cavity could include an entire compartment rotatably connected to the entire launcher. In addition, various features from one of the embodiments may be incorporated into another of the embodiment. Accordingly, it is appropriate that the claims be construed broadly and in a manner consistent with the scope of the disclosure as set forth in the following claims.

What is claimed is:

1. A launcher for a toy vehicle, comprising:

a housing including a top, a bottom configured to support the launcher on a surface, a front, a rear, a first sidewall, and a second sidewall;

a cavity disposed within the housing, the cavity configured to receive a plurality of toy vehicles, where the plurality of toy vehicles are disposed in a vertically stacked alignment within the cavity;

a launching mechanism disposed within the housing that launches a toy vehicle from a launching position within the cavity, the launching mechanism including a vehicle retaining device, and a striking member; and an actuator disposed on the housing and coupled to the launching mechanism, wherein the actuator is a plunger that slidably translates from a first position to a second position, wherein the actuator is closer to the bottom of the housing in the second position, and when the actuator slidably translates to the second position, a portion of the actuator slidably translates into the housing and the actuator causes the striking member to make contact with the toy vehicle.

2. The launcher of claim 1, further comprising:

a cover pivotally coupled to the housing to facilitate outward movement of the cover from the housing during the loading of toy vehicles within the cavity.

3. The launcher of claim 1, wherein the actuator extends from the top of the housing.

4. The launcher of claim 1, wherein the striking member is configured to strike the toy vehicle launching the toy vehicle from the launch position out of the launcher.

5. The launcher of claim 4, wherein the vehicle retaining device includes claw members configured to retain a vehicle when the striking member strikes the toy vehicle in the launch position and then displace another toy vehicle into the launching position.

6. A launcher for a toy vehicle comprising:

a housing including a top, a base, a front, a rear, a first side, and a second side;

a cavity disposed in the front of the housing, the cavity configured to receive a plurality of toy vehicles, where the plurality of toy vehicles are disposed in a vertically stacked alignment within the cavity;

an actuator disposed on the top of the housing, wherein the actuator is a plunger that is actuated when slidably translated from a first position to a second position, wherein the actuator is closer to the base of the housing in the second position, and when the actuator slidably translates to the second position, a portion of the actuator slidably translates into the housing; and a launching mechanism including a striking member, the launching mechanism being disposed within the housing and configured to launch a toy vehicle from a launching position within the cavity, wherein slidable translation of the actuator from the first position to the second position causes the striking member to move from a loaded position to a striking position, where the striking member in the striking position strikes the toy vehicle to propel the toy vehicle, and when the actuator is returned to the first position from the second position, the striking member is returned to the loaded position from the striking position, and another toy vehicle is displaced into the launching position in response to the striking member being returned to the loaded position.

7. The launcher of claim 6, further comprising:

a cover pivotally coupled to the housing to facilitate outward movement of the cover from the housing during the loading of toy vehicles within the cavity.

8. The launcher of claim 6, wherein that launching mechanism includes claw members configured to displace another toy vehicle into the launching position.

9. The launcher of claim 6, further comprising:

a grip disposed on the housing.

10. The launcher of claim 6, further comprising:

a clip disposed on the housing and configured to receive a belt.

11. The launcher of claim 6, further comprising:

a pivotable track portion disposed on the base of the housing.

12. The launcher of claim 11, wherein the launching mechanism includes a ramp configured to displace the launched toy vehicle onto the track portion.

13. The launcher of claim 2, wherein the cover includes an opening proximate to the bottom of the launcher, the toy vehicles being configured to pass through the opening when the launching mechanism launches the toy vehicles.

14. The launcher of claim 13, further comprising a track portion having a first end and a second end, the second of the track portion being pivotally coupled to the bottom of the housing, the track portion pivoting between a closed position, where the first end of the track position is positioned proximate the cover and the track portion covers the opening in the cover, and an open position, where the first end of the track portion is positioned away from the cover and disposed on the support surface.

15. The launcher of claim 1, wherein the each of the plurality of toy vehicles include at least one ball bearing configured to allow each of the toy vehicles to travel over a support surface.

16. The launcher of claim 11, wherein the pivotable track portion comprises a first and a second end, the second end being disposed on the base of the housing, and the pivotable track portion being configured to pivot between a closed position, where the first end of the track portion is positioned proximate the housing, and an open position, where the first end of the track portion is positioned away from the housing and disposed proximate to the support surface.

17. The launcher of claim 6, wherein the each of the plurality of toy vehicles include at least one ball bearing configured to allow each of the toy vehicles to travel over a support surface.

18. A launcher for a toy vehicle, comprising:

a housing including a top, a bottom configured to support the launcher on a surface, a front, a rear, a first sidewall, and a second sidewall;

a cavity disposed within the housing, the cavity configured to receive a plurality of toy vehicles, where the plurality of toy vehicles are disposed in a vertically stacked alignment within the cavity;

a launching mechanism disposed within the housing that launches a toy vehicle from a launching position within the cavity, the launching mechanism including a vehicle retaining device, and a striking member; and an actuator disposed on the housing and coupled to the launching mechanism, wherein the actuator is a plunger that slidably translates from a first position to a second position to establish contact with a push lever, wherein the actuator is closer to the bottom of the housing in the second position, and wherein when the actuator slidably translates to the second position, a portion of the actuator slidably translates into the housing and the actuator contacts the push lever causing the push lever to pivot and actuate the striking member to contact the toy vehicle.

* * * * *